United States Patent [19]

Ruzek et al.

[11] Patent Number: 4,477,249

[45] Date of Patent: Oct. 16, 1984

[54] FLAME-PRODUCING SOUND-EMITTING DEVICE

[76] Inventors: Zdenka Ruzek; Pavel O. Ruzek; Jiri Pesek, all of 181 Reserve St., Boonton, N.J. 07005

[21] Appl. No.: 489,793

[22] Filed: Apr. 29, 1983

[51] Int. Cl.[3] ..... F23D 00/00

[52] U.S. Cl. ..... 431/253; 431/289

[58] Field of Search ..... 431/288, 289, 253

[56] References Cited

U.S. PATENT DOCUMENTS

| | | | |
|---|---|---|---|
| 2,075,883 | 4/1937 | Britsch | 431/253 |
| 2,921,495 | 1/1960 | Ichikawa | 431/253 |
| 3,753,643 | 8/1973 | Golden | 431/288 |
| 3,761,702 | 9/1973 | Andeweg | 431/289 |
| 4,386,904 | 6/1983 | Miyahara | 431/288 |

*Primary Examiner*—Samuel Scott

[57] ABSTRACT

A flame producing device, particularly a candle having a body of combustible material and a wick further includes an optical fiber which extends along the wick to a sensor and carries light from the flame for detection by the sensor. The sensor activates a sound-generating arrangement embodied on a semiconductor chip to produce a series of sounds which are converted by a speaker into an audible melody, so that the lighting of the candle will result in the operation of the sound-generating arrangement which will continue until the candle is extinguished. The chip and various other components of the electric circuitry of the sound-generating arrangement are situated in a casing which is located at the lower region of the candle. The optical fiber is of a material which melts when exposed to the heat of the flame and forms a lenticulate end portion that concentrates the light emitted by the flame into the optical fiber.

21 Claims, 3 Drawing Figures

FLAME-PRODUCING SOUND-EMITTING DEVICE

BACKGROUND OF THE INVENTION

The present invention relates generally to lighting devices, and more particularly to candles and similar flame-producing devices.

Since the advent of mankind, various kinds of lighting devices have been developed and constantly improved to enable humans to see in the dark. Originally, flame-producing devices have been used for this purpose. One of the most popular traditional lighting devices was and is the candle. In modern times, however, with the widespread availability and use of electricity, candles and similar traditional flame-producing devices have lost much of their appeal for their original lighting purpose, and are currently being used only as backups for use during blackouts, outdoors, and to evoke romantic mood, as primary lighting sources. Yet, perhaps the most popular uses of candles nowadays are for decorative purposes and, last but not least, during festive occasions, such as on birthday cakes and the like. In these last-mentioned uses, candles are being used for their aesthetic appeal more than for their ability to light the surroundings, even though they are lit during such festive or other special occasions, such as romantic dinners in candlelight or the like. Yet, experience has shown that the appeal of candles for these special uses still leaves much to be desired and particularly that candles, while contributing to the festive or romantic mood, do not necessarily cause such moods to begin with.

SUMMARY OF THE INVENTION

Accordingly, it is a general object of the present invention to avoid the disadvantages of the prior art.

More particularly, it is an object of the present invention to provide a candle for use during festive, romantic and other special occasions in human life, which candle does not possess the disadvantages of the conventional candles.

It is still another object of the present invention to develop a candle of the type here under consideration which would emit sounds, especially musical sounds or melodies, while lit.

A concomitant object of the present invention is so to design the candle or a similar flame-producing device as to be simple in construction, inexpensive to manufacture, easy to use, and reliable in operation nevertheless.

In pursuance of these objects and others which will become apparent hereafter, one feature of the present invention resides in a sound-emitting flame-producing device which comprises a body of combustible material which is liquid at least when heated to a predetermined temperature; elongated wick means extending through the body and having two ends, one of which extends out of the body and is permeated by a quantity of the combustible material which reacts with the ambient oxygen and is replenished from the body when lit with attendant production of a flame that emits a plurality of radiation components of different wavelengths; sound-generating means disposed at a location which is remote from the one end of the wick means and operative for generating a succession of sounds when activated; and means for activating the sound-generating means upon exposure to at least one of the flame radiation components. Advantageously, the activating means is so constructed as also to inactivate the sound-generating means in the absence of exposure to the one flame radiation component.

An important advantage of the device as described so far is that its appeal to prospective purchasers and eventually to all participants at the special occasion is enhanced, due to the addition of the sound effects to the flickering of the flame of the device, and thus the device will be much more enjoyed by all than comparable flame-producing devices without the sound-producing feature.

According to a currently preferred concept of the present invention, the aformentioned one component is constituted by light, and the activating means includes sensing means sensitive to the one component, the sensing means being situated at the above location and operative for issuing an electrical signal that activates the sound-generating means upon sensing the one component, the activating means further including means for transmitting the one component from the flame to the sensing means. When this expedient is resorted to, there is obtained a particularly simple construction of the device according to the present invention.

Advantageously, the above-mentioned location is situated at the other end of the wick means. Then the transmitting means is preferably elongated and extends along the wick means. It is further advantageous in this context when the elongated transmitting means is transversely spaced from the wick means to avoid interference of one with the performance by the other of its function. In this respect, it is especially advantageous when the body is a candle, and when the transmitting means is embedded in the candle.

Another advantageous aspect of the present invention is that the transmitting means is of a material which disintegrates when heated to a predetermined temperature, so that the gradual exposure of successive zones thereof to heat originating in the flame as the material of the candle melts and its level recedes results in disintegration of such successive zones. This results in a situation where the end of the transmitting means which is close to the one end of the wick means and thus to the flame is always positioned at the desirable distance from the flame and always aims at the flame even as the wick burns away and the flame descends, so that the light emanating from the flame will always enter the transmitting means and propagate in the longitudinal direction of the latter toward the sensing means, so that activation of the sound-generating means is assured irrespective of to what extent the candle height has been reduced by burning of its material.

When referring to disintegration of the material of the transmitting means, one possibility contemplated by the present invention is evaporation of such material. However, a currently preferred kind of disintegration is melting of the material of the transmitting means. This is particularly advantageous when the elongated transmitting means is constituted by at least one optical fiber. In this case, it is especially advantageous when the material of the optical fiber is such that, as it melts, it will form a lenticulate formation at the end portion of the optical fiber that is disposed at the region of the molten combustible material of the candle. This lenticulate portion will then focus the one component, that is, the flame light, into the optical fiber, for propagation toward the sensing means. However, this aspect of the present invention may also be used in other types of flame-producing devices, and not only in candles.

It is particularly advantageous when the sensing means includes a photosensitive sensor, especially a photosensitive switch which has an output electrically connected to the sound-generating means to supply the electrical activating signal thereto, and which is switchable in response to the one component from a first state in which it does not issue, to a second state in which it issues, the electrical activating signal.

The sound-generating means advantageously includes electric circuitry incorporating a plurality of memory locations programmed to generate a series of electrical signals when activated, means including a speaker for converting the series of the electrical signals into the succession of the audible sounds, and means for supplying electric energy to the electric circuitry and to the converting means upon activation of the sound-generating means. A particularly simple, inexpensive and compact construction of the electric circuitry, coupled with low electric energy consumption, is obtained when the electric circuitry is provided on at least one semiconductor chip. In this respect, it is very advantageous when a printed circuit board is situated at the aforementioned location, and when the sensing means and the electric circuitry are mounted on, and are interconnected with one another and with the speaker and the supplying means by, the printed circuit board.

According to another advantageous facet of the present invention, there is provided a casing for accommodating at least the printed circuit board with the elements mounted thereon, the casing having an orifice leading toward the sensing means for the passage of the transmitting means therethrough. Then, it is also advantageous when the supplying means includes at least one battery which is accommodated in the casing, and when the speaker is mounted on the casing, so that there is obtained a compact structural unit. This structural unit is preferably at least partially located within the contour of the body in such a manner that the speaker communicates with the exterior of the body. When the body is, as mentioned before, a candle, it is expedient to provide the candle with a recess at the aforementioned location, and to construct the transmitting means as an optical fiber which extends along the wick means from the region of the one end, that is, of the flame when the candle is lit, to the recess and through the orifice of the casing to the sensing means. A particularly simple and easy assembling operation is obtained when the optical fiber projects into the recess, when the casing is so constructed that at least a portion thereof is snugly received in the recess, and the orifice is so situated that, during insertion of the aforementioned portion of the casing into the recess in a proper orientation, the projecting portion of the optical fiber penetrates into the orifice provided in the casing.

Finally, it is to be mentioned that particularly good results are obtained when the succesion of the audible sounds constitutes at least one melody. The melody may be particularly suited for the occasion for which the particular candle is intended, such as a birthday song for a birthday-cake candle, a Christmas carol for a Christmas candle, and so on. The possibilities in selecting the melody or, provided that the chip storage capacity is sufficient, a number of consecutively played melodies, are numerous and will be determined by the preferences of the consumers for particular melodies or occasions during which they will wish to use the candle of the present invention.

The novel features which are considered to be characteristic of the invention are set forth in the accompanying claims. The improved sound-emitting flame-producing device as constituted by a candle, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
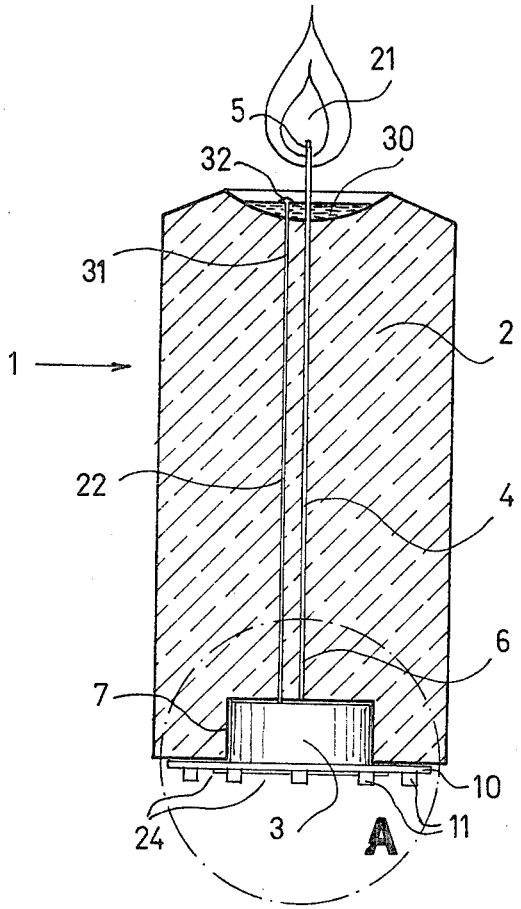
FIG. 1 is a longitudinal sectional view of a candle equipped in accordance with the present invention.

Referring now to the drawing in detail, and first to FIG. 1 thereof, it may be seen that the reference numeral 1 has been used therein to identify the sound-emitting flame-producing device constructed in accordance with the present invention, in its entirety. The device 1 includes a body or candle 2, and a musical member 3, as its basic building blocks or components. The body 2 has a wick 4 embedded therein. The wick 4 has one end portion 5 that extends to the exterior of the body 2 and upwardly as considered in FIG. 1, and another end portion 6. A recess 7 is provided in the candle body 2 at the region of this other end portion 6.

Figure 2:
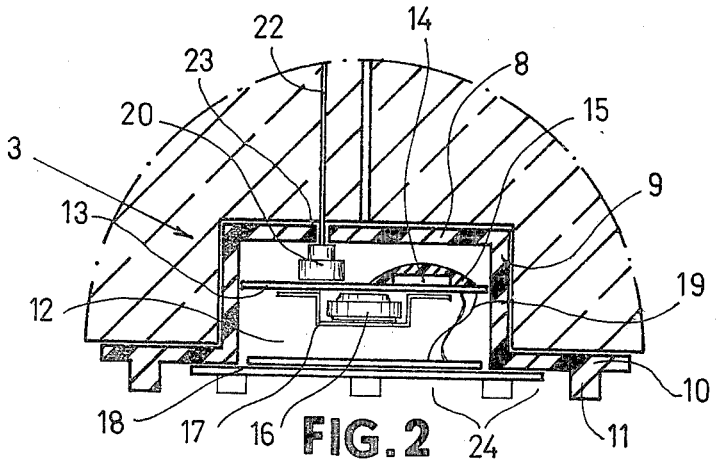
FIG. 2 is an enlarged cross-sectional view of a detail A of FIG. 1, showing the arrangement of various components of a sound-generating arrangement of the present invention.

As shown particularly in FIG. 2, the musical member includes a casing 8, preferably of a synthetic plastic material. The casing 8 includes a substantially cup-shaped portion 9, an annular disc-shaped portion 10 extending from the open end portion of the cup-shaped portion 9 radially outwardly, and an annular base portion 11 which extends to the opposite side of the disc-shaped portion 10 than the cup-shaped portion 9.

Turning now back to FIG. 1, it may be seen that the cup-shaped portion 9 is received in the recess 7 of the body 2, the disc-shaped portion 10 of the casing 8 is juxaposed with the bottom surface of the body 2, and the support or base portion 11 extends downwardly from the disc-shaped portion 10 to form a base of the device 1 in the position of use of the latter as shown in FIG. 1. The recess 7 of the body 2 is so dimensioned as to snugly receive the cup-shaped portion 9 of the casing 8, that is, in such a manner that the casing 8 is prevented from accidentally dissociating itself from the body 8 by falling out of the recess 7.

FIG. 2 also shows that the cup-shaped portion 9 of the casing 8 is hollow, so that it bounds an internal chamber 12 that is open in the downward direction as seen in FIG. 2. The internal chamber 12 accommodates a printed circuit board 13 which is at least frictionally retained in a predetermined position relative to the casing 8, for instance, due to friction between the outer periphery thereof, and the generally cylindrical internal surface of the cup-shaped portion 9 of the casing 8. However, it is also contemplated to provide inwardly extending bulges, beads or other projections on the internal surface of the cup-shaped portion 9 of the casing 8, for the purpose of engaging the periphery of the printed circuit board 13 and thus keeping the printed circuit board 13 in its predetermined position.

An electric circuitry, preferably in the form of at least one semiconductor chip 14, is mounted on the printed circuit board 13. The electric circuitry 14 includes a plurality of memory locations that are programmed to generate a succession of electric signals. Chips of this type are currently available on the market, so that the details of their logic and electrical elements and interconnections and the manner in which they are programmed to generate the electric signals need not be discussed here. Suffice it to say that the electric circuitry 14 can be easily designed using standard electronic and/or logic components.

To protect the chip 14 from deleterious environmental influences, it is covered by a protective body 15, preferably of a synthetic resin. The circuitry of the chip 14 is electrically connected to electrically conductive strips or leads provide on the printed circuit board 13 in a well-known manner. Some of these leads are connected to the terminals of a battery 16, which is also mounted on the printed circuit board 13. To provide for such a mounting, a lug or clip 17 is secured to the printed circuit board 13, as shown, at the opposite side of the latter from the chip 14. The clip 17 has at least an electrically conductive portion, but preferably is made of an electrically conductive material in its entirety, to provide electric connection between the terminal of the battery 16 which faces away from the printed circuit board 14 and the corresponding lead. The battery 16 supplies the electric energy needed for operating the various electrical elements or components of the device 1.

A miniature speaker 18 spans the open end of the internal chamber 12, and is connected to the casing 8, especially to the disc-shaped portion 10 thereof. Such miniature speakers are also commercially available. For connecting the speaker 18 to the casing 8, there may be used, for instance, an adhesive which bonds the periphery of the speaker 18 to the disc-shaped portion 10 of the casing. Electrical conductors or wires 19 connect the speaker 18 with the appropriate leads of the printed circuit board 13, to supply the succession of the electrical signals generated by the chip 14 to the speaker 18, which then converts these signals into a series of audible sounds, in a conventional manner.

According to the present invention, the speaker 18 is to emit the series of audible sounds only when the candle is lit. To achieve this effect, a switching elements 20 including a phototransistor of a conventional construction which needs no elaboration here, is also connected to other leads of the printed circuit board and is operative for activating and inactivating the sound-generating means which is constituted by the chip 14 and the speaker 18, as well as the associated electric circuitry of the printed circuit board 13, by either establishing, or interrupting the electrical connection between the battery 16 and the sound-generating means. The operation of the switching element 20, that is, the switching thereof between its conductive and its non-conductive states, is in turn controlled by the light emitted by a flame 21 that burns at the end portion 5 of the wick 4 when the candle is lit. To achieve transmission of the light of the flame 21 to the switching element 20, an optical fiber 22 is embedded in the material of the body 2 and extends substantially parallel to and at a transverse spacing from the wick 4 from the region of the end portion 5 to and downwardly beyond the region of the end portion 6 of the wick, that is, into the recess 7. The casing 8 is provided with an orifice 23 which is so positioned that, as the cup-shaped portion 9 of the casing 8 is introduced into the recess 7 of the body 2, the end portion of the optical fiber 22 that extends into the recess 7 will penetrate into the orifice 23 and toward or into the photosensitive element or sensing means 20 which is in registry with the orifice 23. FIGS. 1 and 2 also show that the base portion 11 of the casing is provided with a plurality of cutouts 24 through which the sounds emitted by the speaker 18 pass to the exterior of the arrangement 1, as the latter is supported on the base portion 11. Of course, the shape of the portion of the casing 8 which is located outside the body 2, the presence or absence of the cutouts 24 and their location and distribution on the projecting portion of the casing 8, and the very fact whether or not any portion of the casing 8 will project outside the recess 7 in the body 2, will depend on the manner in which the arrangement 1 is intended to be mounted. It will be appreciated that, if the arrangement 1 is to be mounted on a holder having a central spike, the casing 8 will have to be provided with a passage for receiving the spike without damaging the speaker 18; for mounting in holders with peripheral ridges, the casing will have to have a mounting portion below the base portion 11 for insertion into the space bounded by the ridge of the holder, or the portion 11 will have to have a sufficient height to permit such insertion and yet leave a sufficient area of the cutouts 24 unobstructed for the sounds to be heard. Also, the recess 7 may open onto the circumferential surface of the body 2 rather than on the bottom end face, or a separate recess for the speaker 18 may be provided which, unlike the recess for the casing 8, opens onto the circumferential surface of the body 2. Of course, the printed circuit board 13 and the components mounted thereon could also be received directly in the recess 7, that is, without the intermediary of the casing 8, or even embedded, with or without the casing 8, in the material of the body 2, in which case only the speaker 18 would be arranged at the external surface of the body 2.

Figure 3:
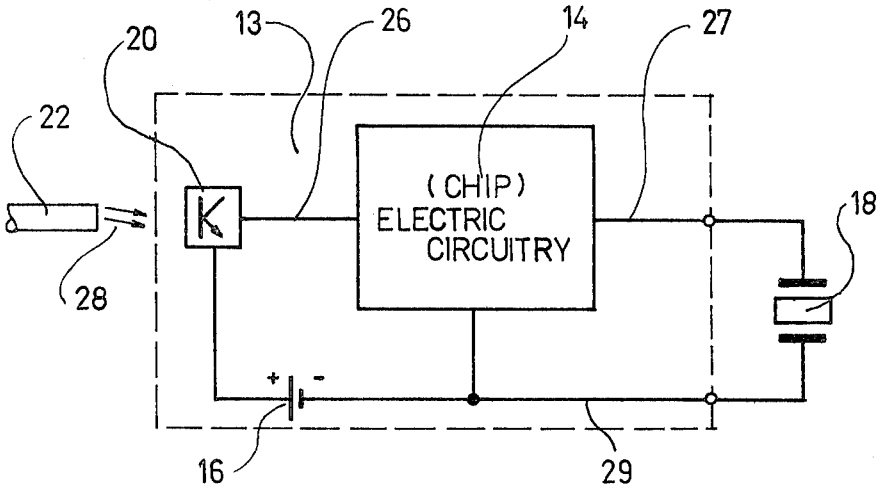
FIG. 3 is a diagrammatic representation of the basic components of the arrangement of FIG. 2.

FIG. 3 shows the basic diagram of the electric circuitry of the device 1 and the way it cooperates with the optical fiber 22. It may be seen that the negative terminal (group) of the battery 16 is connected to a ground line 29 that leads to the chip 14 and to the speaker 18, while the positive terminal of the battery 16 leads to the switching element 20, which has an output 26 that is connected to the chip 14. The switching element is normally non-conductive so that it will interrupt the circuit inclusive of the chip 14. However, when light propagating through the optical fiber 22 falls on the switching element 20, as indicated at 28, the switching element 20 will open and thus establish flow of electric current through to the chip 14, so that the aforementioned succession of electrical signals will be generated by the chip 14 and will appear at an output 27 of the chip 14, which is connected to the speaker 18. In this manner, the succession of the electrical signals will be supplied to the speaker 18 and will energize the same to produce and emit the series of audible sounds. This, of course, presupposes that the signals appearing at the output 27 of the chip 14 have a sufficient energy to drive the speaker 18 without additional amplification. Experience has shown that the energy level obtained at the output 27 is sufficient to drive the piezoelectric transducer 18 as shown in FIG. 3, as well as highimpedance speakers. However, for speakers with low impedance, it may be advisable or even necessary to interpose a suitable amplifier between the output 27 and the speaker. In this manner, it is possible to increase the audibility level of the emitted sounds.

Having so described the construction of the arrangement or device of the present invention, its operation will now be explained with particular reference to FIG. 1.

Obviously, as usual in candles, the body 2 consists of a combustible material which is solid at normal room temperatures. However, when the candle is lit, the flame 21 will emit not only radiation in the visible light range, but also heat radiation which will locally melt the material of the body 2 and thus create a pool of molten combustible material 30 around the end portion 5 of the wick. This molten material will then penetrate into and rise through the end portion 5 of the wick 4, to replenish the quantity of the combustible material in the wick 4, to evaporate due to the heat emitted by the flame 21, and to react with oxygen or burn with attendant production of the flame 21. The light radiation emitted by the flame 21 propagates in all directions, that is, even toward an end portion 31 of the optical fiber 22 that is located at the region of the pool of the molten combustible material 30 and aims at the flame 21. Thus, the light radiation component of the radiant energy emitted by the flame 21 enters the end portion 31 of the optical fiber 22 and then propagates through the fiber 22 until it reaches the photosensitive switch or phototransistor 20, with the consequence described above, that is, the activation of the sound-generating means shown in FIG. 3. Of course, as the flame 21 is extinguished, the light radiation component ceases to exist, so that the transistor 20 reverts to its normal non-conductive state, and the sound-generating means is inactivated or shut off.

The optical fiber 22 is preferably made of a material which melts when exposed to the heat radiation component of the flame 21, or to the heat of the molten combustible material 30 contained in the aforementioned pool, with attendant formation of a lenticulate portion 32 on the end portion 31 of the fiber 22. This lenticulate portion then acts as a lens that focuses the light radiation component emitted by the flame 21 into the optical fiber 22. However, the optical fiber could also be made of a material which disintegrates in a different manner in response to exposure to the radiation emitted by the flame 21, such as by falling apart or by evaporating. The disintegration of the material of the optical fiber 22 at the region of the pool of the molten combustible material 30 is very important to assure that the end portion 31 of the optical fiber 22 will always be in a proper position relative to the flame 21 to let the light radiation component enter and penetrate through the optical fiber 22. It will be appreciated that, were it not for this feature, the flame 21 would eventually descend below the end portion 31 of the optical fiber 22 during the burning of the candle, and the propagation of the light radiation component through the optical fiber 22 toward the phototransistor 20, and thus the operation of the sound-generating means, would cease long before that.

It will be appreciated that, when the casing 8 is partially embedded in the candle 2, the lower region of the candle 2 is not intended to be consumed. In other words, this lower region is to remain intact to serve as an enevlope for the cup-shaped portion 9 of the casing 8. This means that the burning of the candle 8 is to be stopped before the material of this lower region begins to melt. Since this lower region of the candle goes to waste, it is advantageous to minimize its size or volume, which may be accomplished by differently distributing the electrical components therein. Then, the course of the optical fiber 22 through this lower region will not necessarily follow the course of the wick 4; rather, it will lead to the location of the photosensitive switch 20.

To avoid the possibility of a substantial part of the candle 2 going to waste, it is also contemplated by the present invention to construct the casing 8 as a holder for the candle 8, that is, to provide the same with an annular ridge which bounds a recess for receiving the lower region of the candle 8. In this case, the candle 2 will not be provided with the recess 7; rather, it will be constructed like any other candle, except that it will have the optical fiber 22 embedded therein. The shape of the holder-type casing 8 will then be determined by aesthetic and functional considerations, as well as the preferences of the public.

Regardless of the construction of the casing 8, it is further contemplated to combine the optical fiber 22 with the wick 4, by incorporating the same in the latter, winding the same around the latter, or letting the same extending longitudinally of the wick 4 at its outer periphery. This will simplify the manufacture of the candle 2. It is also proposed according to the present invention to provide the casing 8 with upwardly oriented spikes which will dig into the material of the candle 2 and thus secure the casing 8 to the candle 2 and vice versa. The casing 8 may include, instead of the interrupted annular support portion 11, a plurality of individual support projections or legs. Such legs may be constructed in a manner resembling thumb tacks, that is, they could include heads constituting the projections, and spikes penetrating through the disc-shaped portion 10 and into the material of the candle 8.

The speaker 18 can be constituted either by a dynamic speaker, or by an electroacoustic transducer, such as by a piezoelectric crystal. While the photosensitive switching element 20 has been illustrated and described above as being an element separate from the chip 14, it is also contemplated by the present invention to make the same a part of the chip 14. The chip 14 may also include at its input a holding circuit or element which will start the operation of the sound-generating means when the intensity of the light reaching the photosensitive switch 20 exceeds a first, higher, threshold level, and will hold the sound-generating means in its fully operative condition until the light intensity drops below a second, lower, threshold level, by producing a constant output signal until then. This holding circuit may constitute a part of the photosensitive switch 20 or, if the latter is separate from the chip 14, may be interposed between the switch 20 and the chip 14. In this manner, flicking of the flame 21 will not interfere with the operation of the sound-generating means.

Especially when the photosensitive switch 20 is provided directly on the chip 14, it is advantageous when, in accordance with another feature of the present invention, the optical fiber 22 does not reach all the way to the photosensitive switch 20, particularly when it ends at the boundary of the candle 2 and thus does not penetrate into the orifice 23 in the casing 8, only the light emanating from the end of the optical fiber 22 then continuing through the orifice 23 toward the photoelectric switch or sensor 20. This expedient significantly simplifies the assembling operation, since lower precision is required. Also, a short length of optical fiber, separate from the optical fiber 22, could pass through the orifice 23 and be rigidly connected with the casing 8, this length of the optical fiber being aligned with the optical fiber 22.

Finally, it is to be mentioned that the chip 14 is so constructed as to begin its operation always at the beginning of the melody, series of melodies, or any other performance programmed in the chip. This is accomplished by resetting the various components formed on the chip 14 to their initial state either at the end of the previous operation, or at the beginning of the current operation, of the sound-generating means.

It will be understood that each of the elements described above, or two or more together, may also find a useful application in other types of arrangements differing from the type described above.

While the invention has been illustrated and described as embodied in a sound-emitting candle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A sound-emitting flame-producing device, comprising a body of combustible material which is liquid at least when heated to a predetermined temperature;

elongated wick means extending through said body and having two ends one of which extends out of said body and is permeated by a quantity of the combustible material which reacts with ambient oxygen and is replenished from said body when lit with attendant production of a flame that emits a plurality of radiation components of different wavelengths;

sound-generating means disposed at a location which is remote from said one end of said wick means and operative for generating a succession of audible sounds when activated; and means for activating said sound-generating means upon exposure to at least one of said flame radiation components.

2. The device as defined in claim 1, wherein said activating means is also operative for inactivating said sound generating means in the absence of exposure to said one flame radiation component.

3. The device as defined in claim 1, wherein said one component is constituted by light; and wherein said activating means includes sensing means sensitive to said one component situated at said location and operative for issuing an electrical signal that activates said sound-generating means upon sensing said one component, and means for transmitting said one component from said flame to said sensing means.

4. The device as defined in claim 3, wherein said location is at the other end of said wick means; and wherein said transmitting means is elongated and extends along said wick means.

5. The device as defined in claim 4, wherein said transmitting means is transversely spaced from said wick means.

6. The device as defined in claim 5, wherein said body is a candle; and wherein said transmitting means is embedded in said candle.

7. The device as defined in claim 6, wherein said transmitting means is of a material which disintegrates when heated to a predetermined temperature so that the gradual exposure of successive zones thereof to heat originating in said flame as said material of said candle melts and its level recedes results in disintegration of such successive zones.

8. The device as defined in claim 7, wherein said transmitting means includes at least one optical fiber; and wherein said disintegration of said material of said optical fiber involves melting of said successive zones with attendant formation of a lenticulate end portion on said optical fiber at the region of the molten combustible material, which focuses said one component into said optical fiber for propagation toward said sensing means.

9. The device as defined in claim 4, wherein said transmitting means is of a material which disintegrates when situated outside said body so that the gradual exposure of successive zones thereof as the level of said combustible material recedes results in disintegration of said successive zones.

10. The device as defined in claim 8, wherein said transmitting means includes at least one optical fiber; and wherein said disintegration of said material of said optical fiber involves melting of said successive zones as they are exposed to heat originating in said flame, with attendant formation of a lenticulate end portion on said optical fiber at the region of said level, which focuses said one component into said optical fiber for propagation toward said sensing means.

11. The device as defined in claim 3, wherein said sensing means includes a photosensitive sensor.

12. The device as defined in claim 11, wherein said sensor is a photosensitive switch having an output electrically connected to said sound-generating means to supply said electrical signal thereto and switchable in response to exposure to said one component from a first state in which it does not issue, into a second state in which it issues, said electrical signal.

13. The device as defined in claim 3, wherein said sound-generating means includes electric circuitry incorporating a plurality of memory locations programmed to generate a series of electrical signals when activated, means including a speaker for converting said series into said succesion of audible sounds, and means for supplying electric energy to said electric circuitry and to said converting means upon activation of said sound-generating means.

14. The device as defined in claim 13, wherein said electric circuitry is provided on at least one semiconductor chip.

15. The device as defined in claim 13, and further comprising a printed circuit board situated at said location; and wherein said sensing means and said electric circuitry are mounted on, and electrically interconnected with one another and with said speaker and said supplying means by, said printed circuit board.

16. The device as defined in claim 15, and further comprising a casing for accommodating at least said printed circuit board with the elements mounted thereon and having an orifice leading toward said sensing means for the passage of said transmitting means therethrough.

17. The device as defined in claim 16, wherein said supplying means includes at least one battery which is accommodated in said casing, and wherein said speaker is mounted on said casing to thereby form a structural unit.

18. The device as defined in claim 17, wherein said structural unit is at least partially located within the contour of said body in such a manner that said speaker communicates with the exterior of said body.

19. The device as defined in claim 18, wherein said body is a candle having a recess at said location; and wherein said transmitting means includes an optical fiber extending along said wick means from the region of said one end of the latter to said location and through said orifice of said casing to said sensing means.

20. The device as defined in claim 19, wherein said optical fiber projects into said recess; and wherein said casing is so configurated that at least a portion thereof is snugly received in said recess and said orifice is so situated that, during insertion of said portion of said casing in a proper orientation into said recess, the projecting portion of said optical fiber penetrates into said orifice.

21. The device as defined in claim 1, wherein said succession of audible sounds constitutes at least one melody.

* * * * *